US008752556B2

(12) United States Patent
White et al.

(10) Patent No.: US 8,752,556 B2
(45) Date of Patent: Jun. 17, 2014

(54) SMOKING ARTICLE FILTER

(75) Inventors: Peter Rex White, Southampton (GB); Martin Graham Duke, Southampton (GB); William David Lewis, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 726 days.

(21) Appl. No.: 12/282,495

(22) PCT Filed: Jan. 23, 2007

(86) PCT No.: PCT/GB2007/000197

§ 371 (c)(1), (2), (4) Date: Jan. 8, 2009

(87) PCT Pub. No.: WO2007/104908

PCT Pub. Date: Sep. 20, 2007

(65) Prior Publication Data

US 2009/0288671 A1 Nov. 26, 2009

(30) Foreign Application Priority Data

| | | |
|---|---|---|
| Mar. 10, 2006 | (GB) | 0604790.6 |
| Mar. 24, 2006 | (GB) | 0605958.8 |
| Mar. 24, 2006 | (GB) | 0605993.5 |
| Mar. 27, 2006 | (GB) | 0606089.1 |
| Jul. 6, 2006 | (GB) | 0613483.7 |

(51) Int. Cl.
*A24F 1/20* (2006.01)

(52) U.S. Cl.
USPC ..... 131/207; 131/331; 131/202; 131/203

(58) Field of Classification Search
USPC ..... 131/365, 207, 202–203, 331
See application file for complete search history.

(56) References Cited

U.S. PATENT DOCUMENTS

| | | | | |
|---|---|---|---|---|
| 3,805,800 | A * | 4/1974 | Summers | 131/336 |
| 4,185,645 | A | 1/1980 | Boegli et al. | |
| 4,208,956 | A | 6/1980 | Hall | |

(Continued)

FOREIGN PATENT DOCUMENTS

| | | |
|---|---|---|
| EP | 0404580 | 12/1990 |
| GB | 1087909 | 10/1967 |

(Continued)

OTHER PUBLICATIONS

International Search Report and Written Opinion, mailed Apr. 27, 2007, for PCT International Application No. PCT/GB2007/000197, filed Jan. 23, 2007.

(Continued)

*Primary Examiner* — Richard Crispino
*Assistant Examiner* — Dionne Walls Mayes
(74) *Attorney, Agent, or Firm* — N W Poulsen

(57) ABSTRACT

A filter element having a longitudinally extending core and a wrapper (8) engaged around the core, wherein the core comprise filtration material (6) and optionally a particulate material (7) interspersed in the filtration material, and the wrapper (8) comprises a particulate material (9) adhered to two or more portions of said wrapper (8) wherein at least one of said two or more portions extends over the full longitudinal length of said wrapper. Also taught herein is a smoking article comprising said filter element and/or filter comprising said filter element.

14 Claims, 4 Drawing Sheets

(56) References Cited

U.S. PATENT DOCUMENTS

| | | | | | |
|---|---|---|---|---|---|
| 4,227,540 | A | * | 10/1980 | Edison | 131/187 |
| 4,362,172 | A | * | 12/1982 | Johnson | 131/336 |
| 4,998,541 | A | * | 3/1991 | Perfetti et al. | 131/336 |
| 5,404,890 | A | * | 4/1995 | Gentry et al. | 131/342 |
| 5,415,189 | A | * | 5/1995 | Sampson et al. | 131/339 |
| 5,657,772 | A | * | 8/1997 | Duke et al. | 131/334 |
| 5,662,126 | A | * | 9/1997 | Charlton et al. | 131/342 |
| 6,302,114 | B1 | * | 10/2001 | Clarke et al. | 131/365 |
| 2003/0066539 | A1 | | 4/2003 | Figlar | |
| 2003/0098030 | A1 | | 5/2003 | Figlar et al. | |
| 2004/0016436 | A1 | * | 1/2004 | Thomas | 131/202 |
| 2004/0134631 | A1 | * | 7/2004 | Crooks et al. | 162/139 |
| 2004/0200491 | A1 | | 10/2004 | Karles et al. | |
| 2007/0186945 | A1 | * | 8/2007 | Olegario et al. | 131/362 |
| 2010/0319718 | A1 | * | 12/2010 | Schluter et al. | 131/334 |

FOREIGN PATENT DOCUMENTS

| | | |
|---|---|---|
| GB | 2175789 | 12/1986 |
| GB | 2260477 | 4/1993 |
| GB | 2261152 | 5/1993 |
| WO | 96/07336 | 3/1996 |
| WO | 01/41590 | 6/2001 |
| WO | 01/58289 | 8/2001 |
| WO | 03/051144 | 6/2003 |

OTHER PUBLICATIONS

International Preliminary Report on Patentability, mailed Feb. 15, 2008, for PCT International Application No. PCT/GB2007/000197, filed Jan. 23, 2007.

* cited by examiner

SMOKING ARTICLE FILTER

CLAIM FOR PRIORITY

This application is a National Stage Entry entitled to and hereby claims priority under 35 U.S.C. §§365 and 371 corresponding to PCT Application No. PCT/GB2007/000197, titled, "Smoking Article Filter," filed Jan. 23, 2007, which in turn claims priority to British Application Nos. GB0604790.6, filed Mar. 10, 2006, GB0605993.5, filed Mar. 24, 2006, GB0605958.8, filed Mar. 24, 2006, GB0606089.1, filed Mar. 27, 2006 and GB0613483.7, filed Jul. 6, 2006; all of which are hereby incorporated by reference.

The present invention relates to a tobacco smoke filter element, a filter comprising the same and smoking articles comprising a filter and/or a filter element.

The use of carbon or activated carbon in tobacco smoke filter elements to reduce vapour phase constituents of smoke has been known for some while. Commonly, carbon has been utilised in a dual filter arrangement, the carbon granules being sprinkled onto sticky cellulose acetate tow, which tow is gathered in conventional manner and cut into double or triple unit lengths. The double unit lengths of carbon containing acetate are then interdigitated with plain cellulose acetate filter elements having double unit lengths. The interdigitated assemblies are wrapped in plugwrap and then cut in the mid-point of both the carbon-containing filter element double unit length and the plain cellulose acetate double unit length to provide wrapped filter elements having a carbon-containing section adjacent a non carbon-containing section. This type of filter is known as an active acetate or AA filter.

In the alternative, carbon has been utilised in a triple filter arrangement either with the carbon being incorporated in the cellulose acetate tow, as described above and as described in UK Patent Specification No. 1,087,909, or with the carbon being freely held in a cavity between two plugs of tobacco smoke filtration material, such as cellulose acetate, as described in U.S. Pat. No. 4,185,645.

Another alternative and commercially produced carbon filter is the ACT (Active Carbon Thread) Filter made by Filtrona UK, where the carbon in the centre section is adhered to a cotton thread and then surrounded by cellulose acetate. The carbon thread section offers the path of least resistance and the majority of the smoke passes through the carbon centre.

One disadvantage of the dual and/or triple filter mentioned above is that once the filter rod (i.e. when producing filters in a continuous manner) has been formed, the rod has to be cut at a specific point in the rod. Thus it is necessary to have the cutting device and the specific point in the rod (i.e. at the mid-point of both the carbon containing filter element double/triple unit length and the plain cellulose acetate double/triple unit length) in registration prior to cutting the filter rod. In high-speed manufacturing this can slow down the production of the filters and/or result in filters which fail the quality testing due to the fact that the rod has been misaligned with the cutter.

A further known alternative for including carbon or other additives in filters is to adhere particles of the additive to a wrapper surrounding the filter element. GB 2,260,477 and GB 2,261,152 describe various configurations of additive adhesion.

A first aspect of the present invention relates to a filter element having a longitudinally extending core and a wrapper engaged around the core, wherein the core comprises filtration material, and the wrapper comprises a particulate material adhered to two or more portions of said wrapper wherein said two or more portions are circumferentially spaced from one another and at least one of said two or more portions extends over the full longitudinal length of said wrapper.

The two or more portions may be arranged symmetrically around the wrapper.

The two or more portions may comprise two portions arranged in diametrical opposition across the core.

Alternatively, the two or more portions may comprise three, four, five, six, seven or eight portions.

In some embodiments, the core may further comprise a particulate material interspersed in the filtration material.

The particulate material of the core may be the same as the particulate material adhered to the two or more portions of the wrapper. Alternatively, the particulate material of the core may be different from the particulate material adhered to the two or more portions of the wrapper.

The particulate material adhered to each of the two or more portions of the wrapper may be the same. Alternatively, the particulate material adhered to one of the two or more portions of the wrapper may be different from the particulate material adhered to at least one of the other two or more portions of the wrapper.

In some embodiments, the wrapper may further comprise ventilation means. For example, the ventilation means may comprise one or more ventilation holes provided in gaps between the two or more portions.

A second aspect of the present invention provides a filter comprising one or more filter elements according to the first aspect.

A third aspect of the present invention provides a smoking article comprising a filter element according to the first aspect and/or a filter according to the second aspect interattached with a smokable filter material rod. The smoking article may be a cigarette. The cigarette may have a circumference of about 10 mm to about 19 mm.

Preferably the particulate material includes sorbents (e.g. selected from activated carbon, charcoal, silica gel, sepiolite, alumina, ion exchange material etc.), pH modifiers (e.g. alkaline materials such as $Na_2CO_3$, acidic materials), flavourants, other solid additives and mixtures thereof.

Advantageously the particulate material is selected from a group of relatively high surface area materials capable of adsorbing smoke constituents without a high degree of specificity. Suitable general adsorbents can be selected from the group consisting of carbon, activated carbon, activated charcoal, activated coconut carbon, activated coal-based carbon or charcoal, zeolite, silica gel, meerschaum, aluminium oxide (activated or not), carbonaceous resin or combinations thereof.

An example of a suitable coal-based charcoal is one made from semi-anthracite coal with a density about 50% greater than coconut-based charcoal (available from Calgon Carbon, Pittsburgh, Pa., WA).

An example of a suitable carbonaceous resin is one derived from the pyrolysis of sulphonated styrene-divinyl benzene, such as Ambersorb 572 or Ambersorb 563 (available from Rohm and Haas). To enhance the efficiency of the general adsorbent metal oxides or other metal based complexes may optionally be included in or impregnated on the general adsorbent section.

In one embodiment, preferably the particulate material used herein is carbon, for instance activated carbon, or charcoal or other absorbent material. In one embodiment, preferably the activated carbon is activated coconut carbon.

Any particulate material used may be a single substance or a mixture, and/or may be in admixture with other material.

Suitably, the particulate material may cover portions of the inner or outer surface of the wrapper.

Preferably, the particulate material is disposed in separate regions spaced circumferentially from one another.

In one embodiment preferably the particulate material is disposed in two separate regions spaced circumferentially from one another. Alternatively, the particulate material may be disposed in 3, 4, 5, 6, 7 or 8 separate regions each spaced circumferentially from one another. Further, a greater number of regions may be used if required.

Each separate region or portion of particulate material may be comprised of particulate material which is the same as or different from the other separate regions. In one embodiment preferably the particulate material in the separate regions is the same.

In one embodiment, suitably the particulate material may be applied to two or more portions of the longitudinal inner and/or outer faces of the wrapper.

In one embodiment, preferably the particulate material is applied to two or more portions of the longitudinal inner face of the wrapper.

In one embodiment the particulate material is disposed around the inner circumference of the wrapper such that the wrapper has an overlapping longitudinal edge which is free of said particulate material and which provides a lapped and stuck seam holding the wrapper around the core.

The particulate material may extend continuously over the full longitudinal length of said wrapper. By continuously it is meant that the particulate material is applied such that the loading at any one point on the longitudinal length of the wrapper is the same (or substantially the same) as the loading at any other point on the same longitudinal length of the wrapper. By continuously it is meant that at no point along the longitudinal length of the wrapper is there a portion of the wrapper without particulate material if the particulate material is present at another point along the same longitudinal length of the wrapper. Notably, the particulate material according to the present invention is not applied in patches along the longitudinal length of the wrapper. Preferably, the particulate material is applied longitudinally to the wrapper (e.g. plugwrap) in a continuous manner. Preferably along the longitudinal axis of the wrapper the particulate material is present as a continuous stream (i.e. without breaks or spaces). In other words, the particulate material extends in a continuous manner along the longitudinal axis of the wrapper.

The wrapper of the filter element is preferably a paper wrapper.

In one embodiment the wrapper is conventional plugwrap.

In one embodiment the wrapper may be a conventional plugwrap which covers 360° of the core, in which case the plugwrap has a lapped and stuck seam holding the wrapper around the core.

In one embodiment, preferably the filter element according to the present invention has a core comprising particulate material interspersed with the filtration material and has a plugwrap which covers 360° with the core.

In another embodiment the wrapper (in particular plugwrap) preferably does not extend 360° around the core. In other words, in one embodiment preferably the wrapper is a split wrapper. A split wrapper is one which extends circumferentially about the core, but extends less than 360° around the circumference of the core. In such an embodiment, there is not lapped and stuck seam holding the wrapper around the core. Instead, the split wrapper may be held in place by other known means, such as by bonding the wrapper directly to the core for instance.

In one embodiment, preferably the filter element according to the present invention has a core comprising filtration material optionally interspersed with the particulate material and has a split wrapper.

In one embodiment, when the core comprises filtration material only (i.e. without particulate material interspersed therein), preferably the wrapper is a split wrapper.

When applying particulate material to the wrapper of a filter element, to avoid bulging of the sections where the particulate is applied it is advantageous to use a wrapper (plugwrap) having a greater base weight compared with conventional plugwrap material. Conventional plugwrap (wrapper) has a base weight of approximately 23 to approximately 27 grams per square meter (gsm). In the present application, it is therefore preferable to use a wrapper which has one of the following base weights: 28 gsm or more; 29 gsm or more; 30 gsm or more; 35 gsm or more; 38 gsm or more; 40 gsm or more; 45 gsm or more; or 50 gsm or more.

The wrapper for use in the filter element may be porous or non-porous.

The wrapper for use in the filter element may be ventilated or unventilated.

Advantageously the filtration material of the core of the filter element may comprise (or consist of) conventional fibrous cellulose acetate, polypropylene or polyethylene material or gathered paper material.

Preferably the filtration material comprises cellulose acetate.

In some embodiments, the filtration material of the core of the filter element is comprised of fibrous cellulose acetate, polypropylene material, polyethylene material or gathered paper material. Optionally, there may be a particulate material interdispersed therein.

Suitably the particulate material of the core of the filter element, if present, may be one or more of the particulate materials detailed above.

Suitably, the particulate material of the core of the filter element, if present, may be the same as or different from the particulate material adhered to the wrapper.

In one embodiment, preferably the particulate material of the core of the filter element, if present, is the same as the particulate material adhered to the wrapper.

Preferably the particulate material of the core of the filter element, if present, is carbon, activated carbon and/or charcoal interspersed therein, preferably cellulose acetate having carbon or activated carbon interspersed within the fibres thereof.

In one embodiment, the core of the filter element is a Dalmatian filter.

The particulate material in the core may be homogeneous—in the sense that it is made up of substantially the same component (for some embodiments, preferably all of the same). Alternatively, the particulate material in the core may be heterogeneous—in the sense that it is made up of two or more different components.

The particulate material may be interspersed in all of the core. Alternatively, the particulate material may be interspersed in some parts (but not all) of the core. The parts may be evenly or unevenly distributed.

The particulate material may extend over the full longitudinal length of the core. Alternatively, the particulate material may extend from one end of the core to a section that is short of the other end. Alternatively, the particulate material may be present in discrete areas that need not extend from—or be present at—any end of the core. Different areas may have different loadings of particulate material and/or different types of particulate material.

Particulate material, if present in the core, need not be uniformly distributed across the whole of the core. Likewise, the particulate material need not be uniformly distributed with the discrete portions or areas. There may be gaps between the discrete portions or areas—not only between each other but also between groupings of particulate material. An example of the latter is wherein at, or near to, each end of the core there is a grouping of portions of the first particulate material but wherein intermediate each of those two groupings (such as at, or near to, the longitudinal centre of the core) there is an area that has not particulate material. Another example of non-uniform distribution would be at or near to each end of the filter there is a grouping of portions of the first particulate material but wherein intermediate each of those two grouping (such as in or near to the longitudinal centre of the core) there is an area that has less particulate material than either or both of the end groupings.

In some embodiments, some or all of the particulate material in the core extends over the full longitudinal length of the core.

The particulate material adhered to the wrapper may be homogenous—in the sense that it is made up of substantially the same component (for some embodiments, preferably all of the same). Alternatively, the particulate material adhered to the wrapper may be heterogeneous—in the sense that it is made up of two or more different components. The particulate material adhered to the wrapper may be in contact with the core. Preferably, some or all of the particulate material adhered to the wrapper is in contact with the core. For some embodiments, preferably substantially all of the particulate material adhered to the wrapper is in contact with the core.

The filter element is preferably interattached with a smokable filler (e.g. tobacco) rod by way of a tipping wrapper. Advantageously the tipping wrapper is a paper.

In one embodiment the filter element may be the sole filter element in the filter when formed into a smoking article rod.

In another embodiment the filter element may be part of a larger filter. In other words, the filter element may be part of a composite (or multi-component) filter. Suitably the filter elements of the composite filter are arranged longitudinally of one another with the end of each filter element abutting the next. Suitably the composite filter may have 2, 3, 4 or more distinct or discrete sections. However, filters according to the present invention may be of integral construction but have the general appearance of a composite filter. In one embodiment the filter is a triple-filter with three sections. In another embodiment the filter is a dual-filter with two sections.

In the composite filter suitably there may be one or more filter elements according to the present invention. Where there is more than one filter element according to the present invention in the composite filter, suitably the filter elements may be positioned longitudinally next to one another or be separated by a conventional filter element, such as a cellulose acetate filter element.

In a composite filter the filter element may be located at any position within the filter. Suitably however, the filter element is not located at the mouth-end of the filter. In a triple filter for instance the filter element may be the central section. Alternatively, the filter element may be located at the smoking material (e.g. tobacco) rod-end, i.e. the upstream end, of the filter.

Suitably the wrapper is preferably pre-coated with the adhering particulate smoke modifying material.

Suitably the core may be pre-formed before application of the coated wrapper.

Suitably, the formation of the core and application of the coated wrapper may occur substantially simultaneously.

The particulate material may be adhered to the wrapper by hot melt adhesive (e.g. various polyester adhesives), high m.p. polyethylene glycol, or emulsion-type adhesive such as PVA.

The particulate material may be directly or indirectly adhered to the wrapper. An example of direct adherance is wherein the particulate material is affixed to the wrapper (such as the inner surface thereof) by means of a suitable adhesive. An example of indirect adherance is wherein the particulate material is affixed to an intermediate layer (which may be made of paper or other suitable support matrix—such as a textile material—or combinations thereof) by means of a suitable adhesive and wherein the intermediate layer is affixed to the wrapper (such as the inner surface thereof) by means of a suitable adhesive.

Where the filter element is used in a composite filter, suitably the one or more other sections of the composite filter may be comprised of conventional fibrous cellulose acetate, polypropylene or polyethylene material or gathered paper material. The one or more other sections may optionally comprise one or more additives, for instance disposed upon or within the material of the filter element may be further flavouring materials, as described above, which are released or eluted from the filter element by the aerosol generated by the heated or burnt aerosol generation means.

Suitably, one or more sections of the composite filter may be an open ended tube and/or a close ended tube. In a yet further alternative, the composite filter may comprise a section which forms a cavity containing granular material.

Suitably, filter elements having particular pressure drop characteristics, such as the filter sold by Filtrona and known as The Ratio Filter, may also be utilised.

In one embodiment, the composite filter, which may contain particulate material, may be a dual filter comprising, for example, a cellulose acetate mouth section and filter element according to the present invention at the tobacco end of the filter. A paper section may also form part of a multiple filter.

The composite filter may comprise a filter element which is comprised of a selective reduction filter as described in US Patent Application publication number US2003-0066539 and US2003-0098030.

The mouth end located filter plug may be made from a variety of materials, for example, cellulose acetate tow, cellulose, paper, cotton, polypropylene web, polypropylene tow, polyester web, polyester tow or combinations thereof.

In addition, the pressure drop and/or mechanical filtration efficiency of the filter plug sections can be selected to achieve the desired smoking mechanics and filtration characteristics as may be required with the specific product design desired.

In a composite filter arrangement the pressure drop of the filtration material plugs/sections may be varied.

A further filter construction that may be useful in the present invention is that described in our co-pending International Patent Application No. PCT/GB02/005603. The grooved arrangement of the filter described therein provides for ventilating air to enter grooves extending towards the tobacco end and then be re-directed towards the mouth end. The result is a decrease in the CO/tar ratio. In combination with particulate materials that selectively reduce vapour phases a significant reduction in vapour phase constituents can be achieved.

It is much by preference that an upstream portion of the tobacco smoke filter comprises an adsorbent material. Preferably the adsorbent material is a general adsorbent. The general adsorbent material is preferably selected from a group of relatively high surface area materials, such as activated charcoal, which are capable of adsorbing a range of chemical compounds without a high degree of specificity.

Most preferably the general adsorbent is a carbonaceous material such as, for example, activated charcoal, activated coconut carbon, activated coal-based carbon or synthetically derived carbon.

Suitably the particulate material may be in the form of a thread, particles/granules, cloth, paper or a reconstituted sheet (for example a reconstituted carbon-containing sheet), or any other suitable form whatsoever.

Preferably, the particulate material is in the form of particles/granules.

A portion of the filter element and/or the composite filter comprising said filter element may comprise a catalyst. Advantageously the catalyst facilitates the conversion of carbon monoxide (CO) to carbon dioxide ($CO_2$) in the vapour phase of the smoke. It is much by preference that the catalyst is highly selective for carbon monoxide. Preferably the catalyst may be one of the group consisting of transition metal oxides, silica, alumina, zeolites, impregnated carbon, for example, carbon impregnated with metals.

Suitably, the tobacco-rod end portion of the composite filter, and the third portion from the tobacco-rod end (if present), may be a cavity containing an adsorbent and/or catalyst or, alternatively, may comprise a conventional smoke filtration material having an adsorbent and/or catalyst dispersed therein.

Advantageously the adsorbent is capable of retaining at least a portion of the vapour phase of smoke.

Suitably the filter and/or smoking article according to the present invention may comprise ventilation means. For example, the ventilation means may comprise one or more holes in the wrapper engaged around the core. The holes may advantageously be positioned in gaps between the portions of the wrapper to which the particulate material is adhered. Ventilation holes are often formed in filter wrappers by laser piercing. Carbon granules in the region where ventilation is required can cause the laser to produce sparks when the holes are being made. Positioning the ventilation holes in gaps between the portions of particulate material addresses this problem. The arrangement of particulate material on the wrapper in discrete spaced apart portions according to present invention thus facilitates the fabrication of ventilation holes without the risk of sparking.

Possibly, the ventilation means may comprise perforation holes in the tipping wrapper used to interattach the filter or filter element and the rod of wrapped smokable filler (e.g. tobacco) material.

Alternatively the ventilation means may be provided by the use of a porous tipping wrapped used in conjunction with a perforated plugwrap. The porous tipping wrapper may be porous over its full extent or over only a localised extent, which extent is in registration with the underlying perforated plugwrap.

The ventilation means may further be provided at or close to the end of the rod of wrapped smokable filler (e.g. tobacco) material. The ventilation means may be provided in the tipping wrapper or in the cigarette paper wrapper enwrapping the smokable filler (e.g. tobacco) material.

The ventilation means may alternatively or in addition be provided at the location of a member situated between the filter element and the rod of wrapped smokable filler (e.g. tobacco) material.

Preferably, the ventilation is located at the upstream end of the filter element or to the upstream of the filter element.

In one embodiment preferably the filter element and/or filter comprising said filter element is a smoking article filter element, preferably a tobacco smoke filter element.

Suitably, the filter element and/or filter comprising said filter element may be attached to a wrapped smokable filler material rod (i.e. a wrapped tobacco rod for instance) by conventional tipping overwrap to form a smoking article. The tipping overwrap may be ventilating or non-ventilating overwrap.

The length of the smoking material rod is advantageously at least 60 mm and the rod should preferably yield not less than six puffs, and more preferably not less than seven puffs when smoked under standard machine smoking conditions. The rod is preferably of uniform cross-sectional shape and dimensions throughout the length of the rod.

The wrapper enwrapping the smoking article may comprise a burn additive, such as sodium and/or potassium citrate, for example. Other suitable burn additives, such as sodium or potassium salts, such as acetate and tartrate; mono-ammonium phosphate, and di-sodium hydrogen phosphate, for example, will be known to the skilled man. Advantageously the burn additive is present in the range of 0.5-2.5% by weight of the wrapper. The wrapper may also have a basis weight in the range of 20-40 g/m$^2$.

The wrapper of the smoking article may alternatively or in addition be a non-paper wrapper, such as the wrappers described in International Patent Applications, Publications Nos. WO 96/07336 and WO 01/41590. Such wrappers assist in the reduction of sidestream smoke components, but still provide a smoking article which has burning and ashing characteristics similar to conventional products, i.e. the wrappers allow the smoking article to burn down and ash in a similar way to conventional products.

The wrapper may suitably be a paper wrapper or a substantially non-combustible wrapper, such as that described in WO 96/07336. The subject matter of that application as it relates to the substantially non-combustible wrapper is incorporated herein by reference. The wrapper thereof advantageously contains at least 65% inorganic particulate filler material, such as those inorganic materials described above.

A conventional cellulose pulp paper wrapper may have a permeability in the range 2-300 CU and preferably less than 100 CU. Such a wrapper may also be a low total filler paper such as disclosed in European Patent Application No. 0 404 580 and comprising less than 14% magnesium oxide or hydroxide, for example.

Suitably, the smokable filler material may be tobacco material or a tobacco substitute material.

Preferably the smokable material is a tobacco material. Suitably the tobacco material comprises one or more of stem, lamina, tobacco dust. It is preferred that the tobacco material comprises one or more of the following types: Virginia or flue-cured tobacco, Burley tobacco, Oriental tobacco, reconstituted tobacco. It is much by preference that the smokable material comprises a blend of tobacco material. Advantageously the smokable material comprises 10-80% Virginia tobacco, 10-60% Burley tobacco, 0-20% Oriental tobacco, 0-120% reconstituted tobacco and 0-30% expanded tobacco.

The smoking material of smoking articles comprising a filter element according to the subject invention and/or filter comprising a filter element according to the subject invention preferably comprises or consists of cut tobacco, a proportion of which tobacco may be expanded tobacco. The smoking material may comprise reconstituted tobacco or tobacco substitute material.

The smokable filler material may also comprise a burn additive to enhance the smoking properties of the filler material. Depending on the properties of the filler the burn additive is either a burn promoter or a burn retardant. Suitable burn additives may be selected from one or more of salts of Group I or II metals such as acetates, citrates and other burn promoters known to the skilled man. Suitable burn retardants include magnesium hydroxide, mono-ammonium phosphate or magnesium chloride, for example.

The smokable filler material may also comprise an ash improver, which is advantageously present in the filler in the range of 0-5%. Appropriate ash improvers include one or more of mica, perlite, clays, such as, for example, vermiculite, kaolinites, talcs, saponites, bentonites, as well as ash improvers such as disodium hydrogen orthophosphate, sodium carbonate or diammonium phosphate, for example.

The smokable filler material may comprise an inorganic filler material. Advantageously the inorganic filler material is one or more of perlite, alumina, diatomaceous earth, calcium carbonate (chalk), vermiculite, magnesium oxide, magnesium sulphate, zinc oxide, calcium sulphate (gypsum), ferric oxide, pumice, titanium dioxide, calcium aluminate or other insoluble aluminates, or other inorganic filler materials. The density range of the materials is suitably in the range of 0.1-5.7 g/cm$^3$. Advantageously, the inorganic filler material has a density that is less than 3 g/cm$^3$, and preferably less than 2.5 g/cm$^3$, more preferably less than 2.0 g/cm$^3$ and even more preferably less than 1.5 g/cm$^3$. An inorganic filler having a density of less than 1 g/cm$^3$ is desirable. A lower density inorganic filler reduces the density of the product, thus improving the ash characteristics.

The smokable filler material may also comprise an organic filler. Advantageously the organic filler material is inert or relatively inert when alone i.e. will not readily maintain burning, but in a mixture may become more combustible, i.e. will maintain burning. Suitable organic fillers include insoluble alginates, such as calcium or magnesium alginate, calcium pectinate or alginic acid, as well as non-modified cellulose, such as treated or non-treated wood pulp or alpha cellulose, for example. Mixtures of inert organic fillers and inorganic fillers may also be used.

The smokable filler material may comprise aerosol generating means. Preferably the aerosol generating means is present in the range of 5-20%, more preferably is less than 15%, is even more preferably greater than 7% and even more preferably is greater than 10%. Preferably the aerosol generating means is less than 13%. Most preferably the aerosol generating means is between 11% and 13%, and may advantageously be about 11.25% or 12.5%, by weight of the final sheet material. Suitably the amount of aerosol generating means is selected in combination with the amount of tobacco material to be present in the blend comprising the smokable filler material of a smoking article. For example, in a blend comprising a high proportion of sheet material with a low proportion of tobacco material, the sheet material may require a lower loading level of aerosol generating means therein. Alternatively in a blend comprising a low proportion of sheet material with a high proportion of tobacco material, the sheet material may require a higher loading level of aerosol generating means therein.

Suitable aerosol generating means include aerosol forming means selected from polyhydric alcohols, such as glycerol, propylene glycol and triethylene glycol; esters, such as triethyl citrate or triacetin, high boiling point hydrocarbons, or non-polyols, such as glycols, sorbitol or lactic acid, for example. A combination of aerosol generating means may be used. An additional function of the aerosol generating means is the plasticising of the sheet material. Suitable additional plasticisers include water.

Suitably, the smokable filler material may comprise a binder. Advantageously, if the binder is a mixture of alginate and non-alginate binders, then preferably the binder is comprised of at least 50% alginate, preferably at least 60% alginate and even more preferably at least 70% alginate. The amount of combined binder required may suitably decrease when a non-alginate binder is utilised. The amount of alginate in a binder combination advantageously increases as the amount of combined binder decreases.

The binder may be an organic binder, such as an alginate, a gum, a cellulose (modified or natural), a pectin or pectinaceous binder, or the Group I or II metal salts of these binders, such as sodium carboxymethylcellulose or sodium alginate.

Much preferred binders are alginic binders which include soluble alginates such as ammonium alginate, sodium alginate, sodium calcium alginate, calcium ammonium alginate, potassium alginate, triethanol-amine alginate and propylene glycol alginate. Alginic binders provide the preferred smoking mechanics and taste and flavour properties for the smokable filler according to the invention.

Cellulosic binders include, for example, cellulose derivatives, such as sodium carboxymethylcellulose, methyl cellulose, hydroxypropylcellulose, hydroxyethyl cellulose or cellulose ethers. These binders are preferred for extrusion purposes.

Other organic binders include gums such as gum arabic, gum ghatti, gum tragacanth, Karaya, locust bean, acacia, guar, quince seed or xanthan gum, or gels such as agar, agarose, carrageenans, fucoidan and furcellaran. Pectins and pectinaceous materials can also be used as binders. Starches can also be used as organic binders. Other suitable gums can be selected by reference to handbooks, such as Industrial Gums, Ed. Whistler (Academic Press). Inorganic non-combustible binders, such as some cements, for example, Portland cement, may also be used. Combinations of the above may also be used.

The smokable filler material may comprise one or more flavouring and/or colouring agents. Flavouring agents in the smoking material rod are designed to contribute towards an aerosol which has a unique but very acceptable taste and flavour characteristic to the aerosol smoke. The taste and flavour may not necessarily be designed to imitate tobacco smoke taste and flavour. Flavouring agents may include tobacco extract flavours, menthol, vanillin, toffee, chocolate or cocoa flavours, for example.

Colouring means, such as food grade dyes, for example, or colourants such as liquorice, caramel or malt, or extracts thereof, may be used to darken the colour of the filler material. The presence of vermiculite or other inorganic material, such as iron oxide, may also give a darker colour to the filler material of the smoking article.

Advantageously the smoking material comprises a colourant to darken the material and/or a flavourant to impart a particular flavour. Suitable flavouring or colourant materials include cocoa, liquorice, caramel, chocolate or toffee, for example. Finely ground, granulated or homogenised tobacco may also be used. Industry approved food colourants may also be used, such as E150a (caramel), E151 (brilliant black BN), E153 (vegetable carbon) or E155 (brown HT). Suitable flavourants include menthol and vanillin, for example. Other casing materials may also be suitable. In the alternative, the presence of vermiculite or other inorganic filler materials may give a darker colour to the smoking material.

Preferably the colourant is present from 0-10% and may be as much as 5-7% by weight of the final smoking material. Advantageously the colourant is less than 7% preferably less than 6% and more preferably less than 5% of the final smoking material. Much preferred is use of colourant at less than 4%, less than 3% and less than 2%. Cocoa may suitably be present in a range of 0-5% and liquorice may be present in a range of 0-4%, by weight of the final smoking material. When the colourant is cocoa or liquorice, for example, the minimum amount of cocoa to obtain the desired sheet colour is about 3% and for liquorice is about 2%, by weight of the final smoking material. Similarly, caramel may suitably be present in a range of 0-5%, preferably less than about 2% by weight of the final smoking material, and more preferably about 1.5%. Other suitable colourants include molasses, malt extract, coffee extract, tea resinoids, St. John's Bread, prune extract or tobacco extract. Mixtures of colourants may also be used.

Flavourants may also be added to alter the taste and flavour characteristics of the smoking material.

Advantageously, if a food dye is utilised in the alternative it is present at 0-5% by weight or less of the final smoking material. The colourant may alternatively be dusted into the sheet after sheet manufacture.

Flavours that may be used in the present invention include volatile flavours such as menthol, vanillin, peppermint, spearmint, isopinocampheol, isomenthone, mint cooler (obtained from the flavour house IFF), neomenthol, dill seed oil or other similar flavour materials, and mixtures thereof. The invention is suitable for any volatile or semi-volatile flavourant.

The term 'carbon' as used herein can be taken to cover a material which is substantially solely carbon and any carbon precursors, such as carbonaceous material. As used herein the term carbonaceous includes material which has been pyrolysed, which material preferably contains carbon, although some incomplete combustion products may still be present. Ready pyrolysed coconut fibre may, for example, be the carbonaceous material from which carbon is derived.

As used herein, the term 'smoking material' means any material which can be used in a smoking article. It does not necessarily mean that the material itself will necessarily sustain combustion. The smoking material is usually produced as a sheet, then cut. The smoking material may then be blended with other materials to produce a smokable filler material.

One advantage of the present invention is that as at least one of the two or more portions of the particulate material extend over the full longitudinal length of said wrapper there is no need to register a "patch" of particulate material with a cutter during filter production. This has major advantages during high speed manufacture.

Another advantage is that if the portions are disposed about the core with symmetrical spacing, any distortion or bending of the filter that may caused by the presence of the particulate material on the wrapper is reduced or removed. The symmetrical arrangement allows any pulling of the particulate material to be balanced out, thus keeping the filter element straight.

One further advantage is that the filter element according to the present invention permits an increased amount of particulate material (carbon) in said filter compared with conventional filters having particulate material interspersed in the core (i.e. without extending the length of the filter). The presence of carbon in the filter has two main advantages: the first is to deodorize the filter after the smoking article has been extinguished (in other words reduce the "ashtray smell" in an ashtray); and the second is to adsorb or absorb more constituents from the smoke during its passage through the filter. Providing the particulate material on separate portions of the wrapper allows the amount of particulate material to be varied as required by selection of the width and number of the portions, compared to the option of adhering particulate material across the full width of the wrapper.

Another advantage is that the present invention allows for the provision of two or more different types of particulate material within the filter element. The differences may be in source and/or type and/or size, etc.

Also advantageously, the present invention addresses the problem of increasing the particulate material (carbon) loading of the filter while minimising heating problems during manufacture, particularly in the case of slim cigarettes. These cigarettes have circumferences of 10-19 mm (approximately 3-7 mm in diameter) as compared with standard cigarettes (which have circumferences of 22 mm or more). GB 2,175,789 discloses some information about "super slims".

In this respect, the presence of carbon particulate material in, say, a Dalmatian filter, tends to cause the filter material to heat up whilst being processed, due to friction. The heating effect increases with the loading of the particulate material, and also as the diameter of the filter decreases. The heating problem is therefore particularly acute in the case of filters for "super slim" cigarettes. The present invention addresses the problem of how to increase the carbon loading of the filter without increasing heating problems during manufacture, particularly in the case of slim cigarettes.

In order that the subject invention may be easily understood and readily carried into effect, reference will now be made, by way of example, to the accompanying diagrammatic drawings, in which.

Figure 5A:
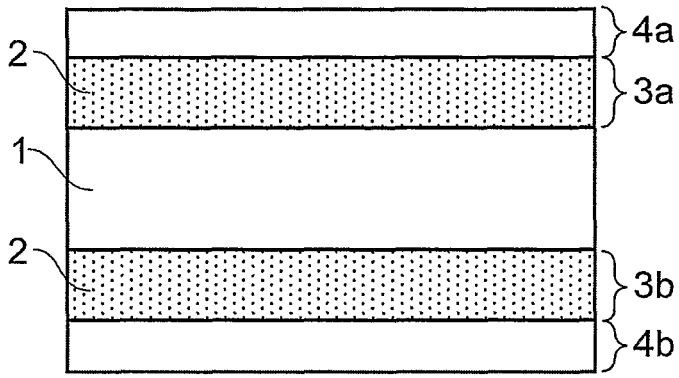
Figure 5B:
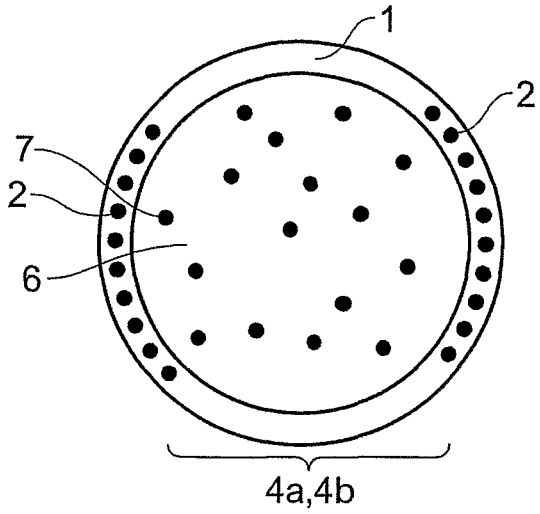

FIG. 5*a* shows a surface of a wrapper (plugwrap) having the particulate material applied thereto;

FIG. 5*b* shows an axial cross-section of a filter element according to the present invention, having the wrapper shown in FIG. 5*a*.

FIGS. 6*a* and 6*b* and 7*a* and 7*b* show surfaces of wrappers and axial cross-sections of filter elements similar to those of FIGS. 5*a* and 5*b* but comprising alternative arrangements of particulate material on the wrapper.

Figure 8A:
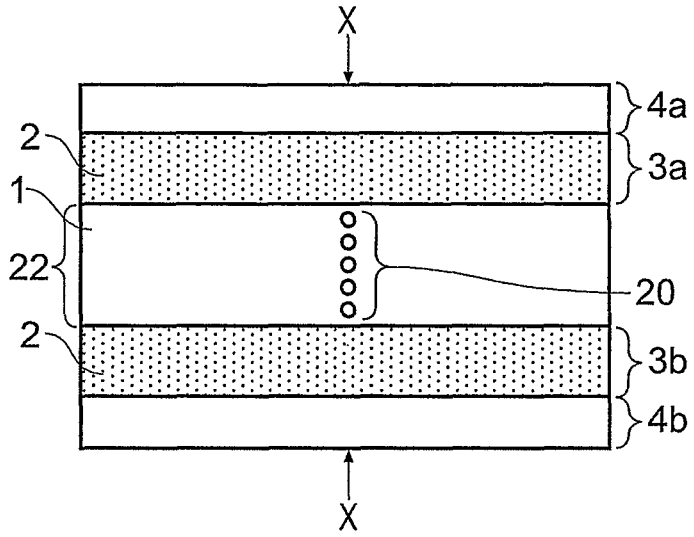
Figure 8B:
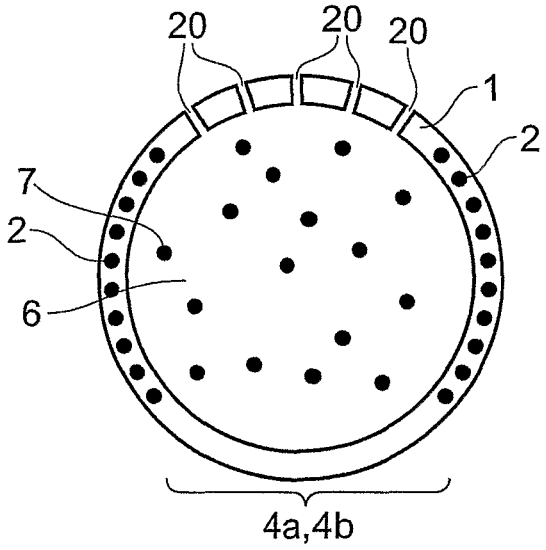

FIGS. 8*a* and 8*b* show a surface of a wrapper and an axial cross section of a filter element similar to those of FIGS. 5*a* and 5*b*, but having ventilation holes in accordance with a further embodiment.

Figure 1:
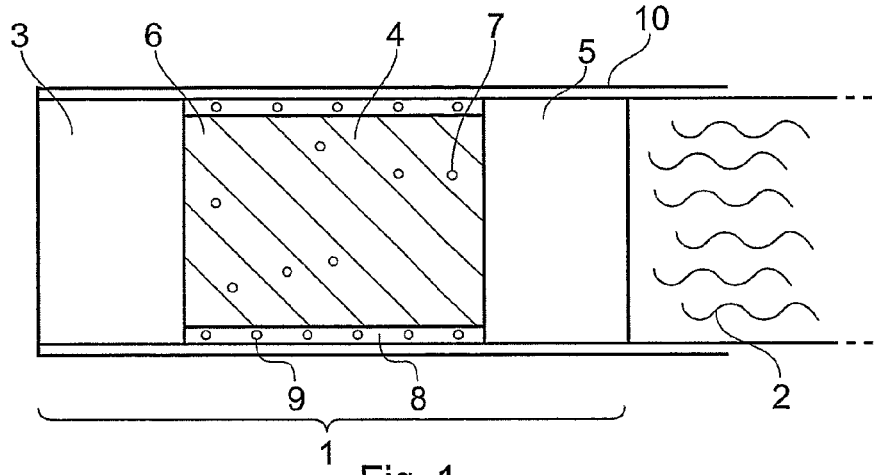
FIG. 1 shows a longitudinal cross-section of a triple filter arrangement with the filter element of the present invention in the central section.

FIG. 1 shows a composite filter 1, in particular a triple filter, interattached with a smoking material rod 2 comprising a smokable filler material (only a portion of which is shown). Suitably the filter 1 may be attached to the smoking material rod 2 by a tipping wrapper 10. The triple filter comprises three section (3, 4 and 5). Sections 3 and 5 may be comprised of any conventional filtration material. Preferably, sections 3 and 5 are comprised of fibrous cellulose acetate. The central section 4 is a filter element according to the present invention, comprising a filtration material 6, such as cellulose acetate, and a particulate material 7, such as carbon or activated carbon interspersed in the said filtration material. The particulate material 7 in the central core is optional (although in some embodiments preferred) and thus the core of the central section 4 may be comprised of filtration material 6 only in some embodiments. The central section 4 further comprises a wrapper 8 (preferably a plug wrap material but with a base weight of at least 30 gsm), having a particulate material 9, such as carbon or activated carbon, adhered thereto.

Figure 2:
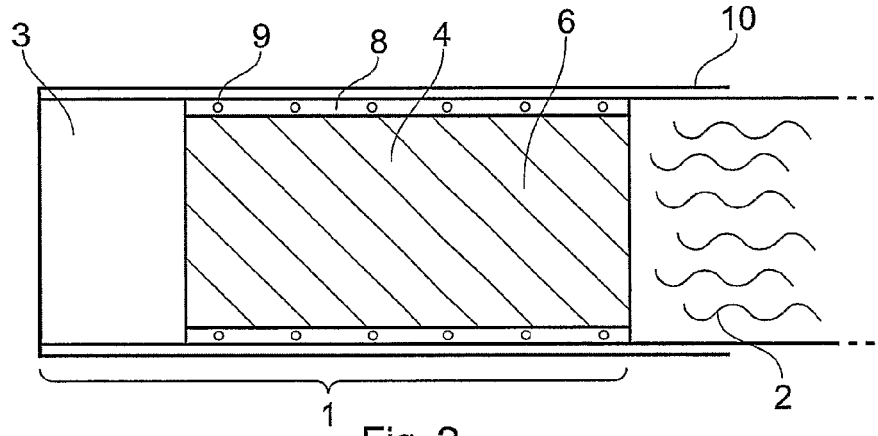
FIG. 2 shows a longitudinal cross-section of a dual filter arrangement with the filter element of the present invention in the upstream section.

FIG. 2 shows a composite filter 1, in particular a dual filter, interattached with a smoking material rod 2 comprising a smokable filler material (only a portion of which is shown). Suitably the filter 1 again may be attached to the smoking material rod 2 by a tipping wrapper 10. The dual filter comprises two sections (3 and 4). The mouth-end section 3 may be comprised of any conventional filtration material. Preferably section 3 is comprised of fibrous cellulose acetate. The upstream section 4 is a filter element according to the present invention, comprising a filtration material 6, such as cellulose acetate. Optionally the filtration material 6 may have a particulate material, such as carbon or activated carbon interspersed therein. The filter element 4 further comprises a wrapper 8 (preferably a plug wrap material but with a base weight of at least 30 gsm), having a particulate material 9, such as carbon or activated carbon, adhered thereto. The wrapper may envelope at least 360° of the longitudinal axis of the core, and have a lapped and seamed region. Alternatively, the wrapper may be a split wrapper bonded to the core. Where the filtration material 6 does not have a particulate material interspersed therein, preferably the wrapper is a split wrapper.

Figure 3:
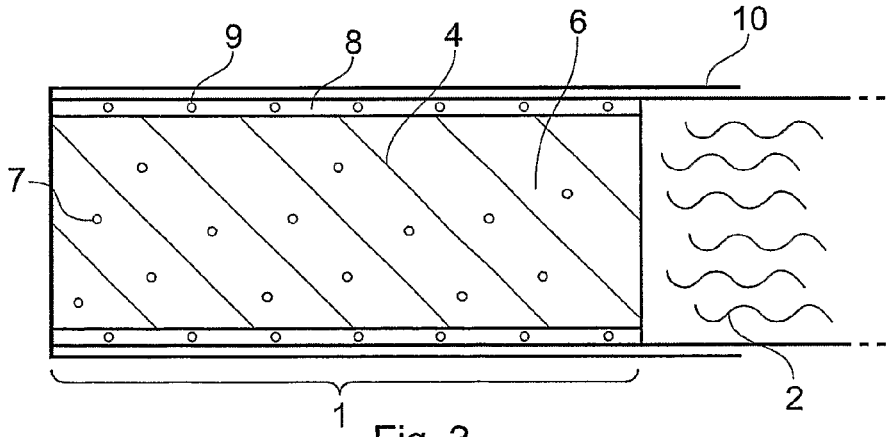
FIG. 3 shows a longitudinal cross-section of a filter comprised of a single filter element according to the present invention.

FIG. 3 shows filter 1 comprised solely of the filter element 4 according to the present invention interattached with a smoking material rod 2 comprising a smokable filler material (only a portion of which is shown). Suitably the filter 1 again may be attached to the smoking material rod 2 by a tipping wrapper 10. The filter section 4 is a filter element according to the present invention, comprising a filtration material 6, such as cellulose acetate, and a particulate material 7, such as carbon or activated carbon interspersed in the said filtration material. The particulate material 7 in the central core is optional (although in some embodiments preferred) and thus the core of the central section 4 may be comprised of filtration material 6 only in some embodiments. The filter element 4 further comprises a wrapper 8 (preferably a plug wrap material but with a base weight of for example at least 35 gsm), having a particulate material 9, such as carbon or activated carbon, adhered thereto.

Figure 4:
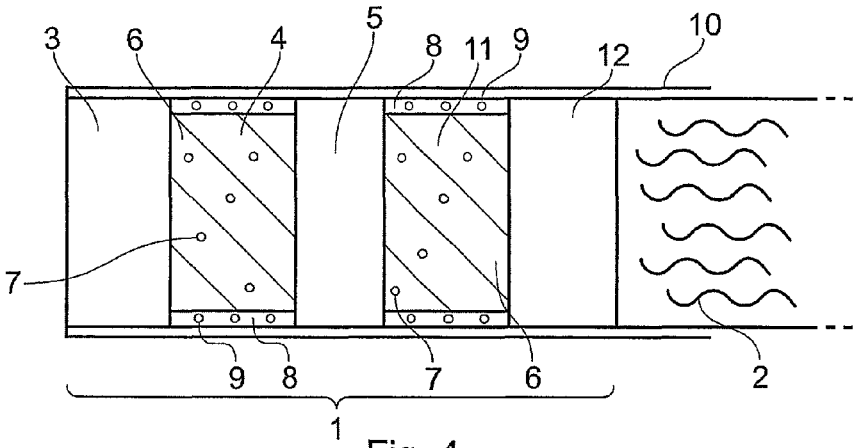
FIG. 4 shows a longitudinal cross-section of a filter comprised of multiple filter elements according to the present invention.

In FIG. 4 there is depicted a composite filter 1, in particular a filter having multiple sections, interattached with a smoking material rod 2 comprising a smokable filler material (only a portion of which is shown). Suitably the filter 1 may be attached to the smoking material rod 2 by a tipping wrapper 10. The composite filter here comprises five sections (3, 4, 5, 11 and 12). Sections 3, 5 and 12 may be comprised of any conventional filtration material. Preferably, sections 3, 5 and 12 are comprised of fibrous cellulose acetate. Sections 4 and 11 are filter elements according to the present invention, comprising a filtration material 6, such as cellulose acetate, and a particulate material 7, such as carbon or activated carbon interspersed in the said filtration material. The particulate material 7 in the central core is optional (although in some embodiments preferred) and thus the core of sections 4 and 11 may be comprised of filtration material 6 only in some embodiments. Sections 4 and 11 further comprises a wrapper 8 (preferably a plug wrap material but with a base weight of at least 30 gsm), having a particulate material 9, such as carbon or activated carbon, adhered thereto FIG. 5*a* shows a surface of a wrapper (plugwrap) having the particulate material applied thereto. The particulate material 2 is disposed in separate regions or portions (in this case two separate regions) spaced from one another on the inner surface of the wrapper 1. Each of the separate regions of particulate material 2 extends only partially across the width of the wrapper (3) and longitudinal edges 4*a* and 4*b* are free of the particulate material, thus providing a lapped and stuck seam free from particulate when formed around the core.

FIG. 5*b* shows an axial cross-section of a filter element according to the present invention, having the wrapper shown in FIG. 5*a*. In particular, the filter element comprise a central core 6 comprised of filtration material, preferably cellulose acetate, and a particulate material 7, such as carbon or activated carbon interspersed in the said filtration material. The particulate material 7 in the central core is optional (although in some embodiments preferred) and thus the core 6 may be comprised of filtration material only in some embodiments. Wrapped around the core is the wrapper 1 of FIG. 5*a*. As can be seen, the particulate material 2 is disposed in two separate regions spaced circumferentially from one another. In addition, the particulate material extends only partially around the inner circumference of the wrapper 1, such that the wrapper may have a lapped (not shown) and stuck seam (not shown) holding the wrapper 1 around the core 6 in a region where no particulate material 2 was applied to the wrapper 1 (i.e. regions 4*a* and 4*b*). In other words section 4*a*, 4*b* forms a plugwrap gluing zone with no particulate. Alternatively, the wrapper 1 may be a split wrapper and thus a region (such as 4*a* and 4*b* for example) may not be covered by a wrapper. In the split wrapper arrangement, the wrapper may be held in place by bonding the wrapper directly to the core for example.

Figure 6A:
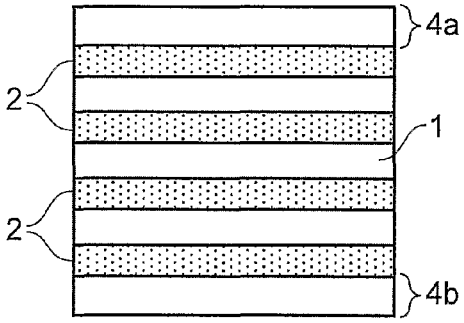
Figure 6B:
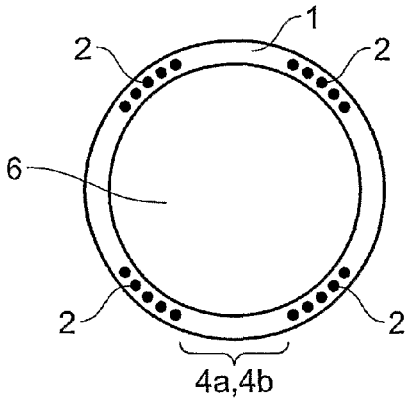

FIGS. 6*a* and 6*b* correspond to FIGS. 5*a* and 5*b* but illustrate an embodiment in which the particulate material 2 is applied to four separate portions of the wrapper 1. The four portions are arranged such that when the wrapper 1 is engaged around the core 6, the four portions are symmetrically arranged around the circumference of the core, as shown in FIG. 6*b*. Again, the longitudinal edge sections 4*a*, 4*b* of the wrapper are left free from particulate material 2 so as to form a gluing zone. In this example, the core 6 does not have particulate material interspersed in the filtration material.

Figure 7A:
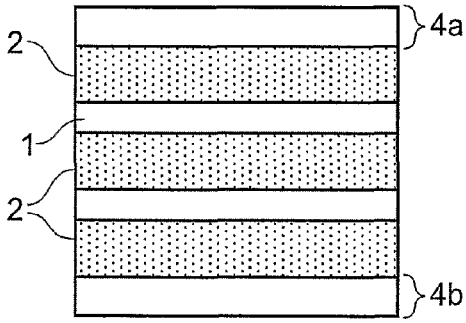
Figure 7B:
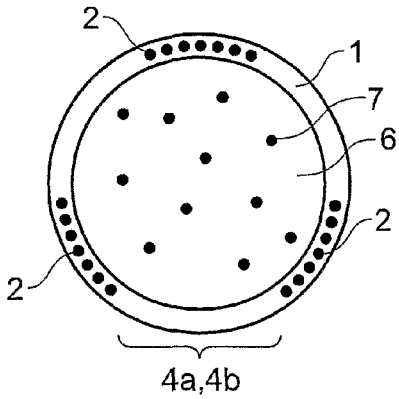

FIGS. 7*a* and 7*b* also correspond to FIGS. 5*a* and 5*b*, but illustrate an embodiment with three portions of particulate material 2 applied to the wrapper 1, and arranged to give a symmetrical spacing of the portions around the core 6 when the wrapper 1 is engaged around the core 6. The longitudinal edges 4*a*, 4*b* of the wrapper again form a gluing zone free from particulate material 2. However, in this example, particulate material 7 is included in the core 6, as in the embodiment of FIG. 5*b*.

Other quantities of wrapper portions with applied particulate material may also be used, such as five, six, seven or eight portions. Such arrangements may be analogous to those shown in FIGS. 5*a*, 5*b*, 6*a*, 6*b*, 7*a* and 7*b* in that the portions are evenly and symmetrically positioned around the core. However, other spacings might be used. Also, the portions on a particular wrapper may or may not be all of equal width, and may or not be of equal width with the gaps between the portions. Further, the gaps on a particular wrapper need not all be of equal width. Also, not all portions on a given wrapper need extend over the full longitudinal length of the wrapper. For any number of portions, only one portion need extend over the full length; the remaining portion or portions may or may not so extend.

Preferably the spaced regions are symmetrically arranged around the circumference of the wrapper 1. In other words, the portions of the wrapper to which the particulate material is applied are disposed so that the portions are symmetrically spaced around the core when the wrapper is engaged around the core. The symmetrical arrangement obviates bending or curving of the filter element that can arise in a non-symmetric arrangement if the adhered particulate material pulls on and distorts the wrapper and hence the filter.

As can be seen from FIG. 6*a* and FIG. 6*b* the particulate material 2 extends over the full longitudinal length of the said wrapper 1. Preferably the particulate material 2 extends continuously over the full longitudinal length of said wrapper 1.

FIG. 8*a* shows a plan view of a wrapper 1 having particulate material 2 applied thereto in two portions, as previously described with regard to FIG. 5*a*. In addition, this wrapper includes ventilation means. In this example, the ventilation means comprise a line of holes or perforations in the wrapper, the line running perpendicularly to the length of the wrapper. When the wrapper is positioned around a core 6, the holes form a partial ring of ventilation holes arranged circumferentially around the filter element. This can be seen in FIG. 8*b*, which is an axial cross section through a filter element wrapped with the wrapper of FIG. 8*a*, along the line X-X in FIG. 8*a*. It will be noted that the holes are positioned only in that part of the wrapper where there is a gap 22 between the two portions of particulate material 2. Confining the holes away from the particulate material in this way removes or reduces the risk of sparking when making the holes using a conventional laser technique. However, if an alternative hole fabrication technique is used, the line of holes 20 may extend further or completely across the width of the wrapper 1, possibly including the portions with the particulate material, to give a complete or near-complete ring of holes around the circumference of the filter element.

All publications mentioned in the above specification are herein incorporated by reference. Various modifications and variations of the described methods and system of the present invention will be apparent to those skilled in the art without departing from the scope of the present invention. Although the present invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

REFERENCES

GB 2,260,477
GB 2,261,152
GB 1,087,909
U.S. Pat. No. 4,185,645
US 2003-0066539
US 2003-0098030
PCT/GB02/005603
WO 96/07336
WO 01/41590
WO 96/07336
EP 0,404,580

The invention claimed is:

1. A filter element comprising:

a longitudinally extending core and a wrapper engaged around the core, wherein the core comprises filtration material, which comprises at least one of cellulose acetate, polypropylene material, polyethylene material and gathered paper material, and the wrapper comprises a particulate material adhered to two or more portions of said wrapper, wherein said two or more portions are spaced symmetrically and circumferentially from one another and said two or more portions extend over the full longitudinal length of said wrapper, and the particulate material comprises one or more sorbents capable of absorbing vapour phase constituents of smoke.

2. The filter element according to claim 1, wherein the two or more portions comprise two portions arranged in diametrical opposition across the core.

3. The filter element according to claim 1, wherein the two or more portions comprise three, four, five, six, seven or eight portions.

4. The filter element according to claim 1, wherein the core further comprises a particulate material interspersed in the filtration material.

5. The filter element according to claim 4, wherein the particulate material of the core is the same as the particulate material adhered to the two or more portions of the wrapper.

6. The filter element according to claim 4, wherein the particulate material of the core is different from the particulate material adhered to the two or more portions of the wrapper.

7. The filter element according to claim 1, wherein the particulate material adhered to each of the two or more portions of the wrapper is the same.

8. The filter element according to claim 1, wherein the particulate material adhered to one of the two or more portions of the wrapper is different from the particulate material adhered to at least one of the other two or more portions of the wrapper.

9. The filter element according to claim 1, wherein the wrapper further comprises one or more ventilation means.

10. The filter element according to claim 9, wherein the ventilation means comprises one or more ventilation holes provided in gaps between the two or more portions.

11. A filter comprising one or more filter elements, said filter elements comprising:

a longitudinally extending core and a wrapper engaged around the core, wherein the core comprises filtration material and the wrapper comprises a particulate material adhered to two or more portions of said wrapper, wherein said two or more portions are spaced symmetrically and circumferentially from one another and said two or more portions extend over the full longitudinal length of said wrapper, and the particulate material comprises one or more sorbents capable of absorbing vapour phase constituents of smoke.

12. A smoking article comprising a filter interattached with a smokable filler rod, wherein the filter comprises one or more filter elements, said filter elements comprising:

a longitudinally extending core and a wrapper engaged around the core, wherein the core comprises filtration material and the wrapper comprises a particulate material adhered to two or more portions of said wrapper, wherein said two or more portions are spaced symmetrically and circumferentially from one another and said two or more portions extend over the full longitudinal length of said wrapper, and the particulate material comprises one or more sorbents capable of absorbing vapour phase constituents of smoke.

13. The smoking article according to claim 12, wherein said article is a cigarette.

14. The smoking article according to claim 13, wherein said cigarette has a circumference of about 10 mm to about 19 mm.

* * * * *